US009039463B2

(12) United States Patent
Yamashita et al.

(10) Patent No.: US 9,039,463 B2
(45) Date of Patent: May 26, 2015

(54) CONNECTOR AND WIRE HARNESS

(75) Inventors: Nobuyuki Yamashita, Hitachi (JP); Masaaki Imahori, Hitachinaka (JP)

(73) Assignee: HITACHI METALS, LTD., Tokyo (JP)

( * ) Notice: Subject to any disclaimer, the term of this patent is extended or adjusted under 35 U.S.C. 154(b) by 76 days.

(21) Appl. No.: 13/558,767

(22) Filed: Jul. 26, 2012

(65) Prior Publication Data

US 2013/0065426 A1 Mar. 14, 2013

(30) Foreign Application Priority Data

Sep. 8, 2011 (JP) ..... 2011-195842
Mar. 6, 2012 (JP) ..... 2012-048666

(51) Int. Cl.
*H01R 13/11* (2006.01)
*H01R 13/187* (2006.01)
*H01R 13/631* (2006.01)

(52) U.S. Cl.
CPC ..... *H01R 13/187* (2013.01); *H01R 13/6315* (2013.01)
USPC ..... 439/852; 439/449

(58) Field of Classification Search
CPC ..... H01R 13/04; H01R 13/11; H01R 13/111; H01R 13/113; H01R 13/187; H01R 13/58; H01R 13/74; H01R 13/4223; H01R 23/661; H01R 33/00; H01R 4/4818
USPC ..... 439/449, 483, 556, 559, 851, 852
See application file for complete search history.

(56) References Cited

U.S. PATENT DOCUMENTS

| | | | | |
|---|---|---|---|---|
| 4,911,660 | A * | 3/1990 | Alf et al. | 439/585 |
| 5,895,282 | A * | 4/1999 | Little | 439/332 |
| 6,109,975 | A | 8/2000 | Nitta | |
| 6,354,890 | B2 * | 3/2002 | Adkins et al. | 439/843 |
| 6,364,683 | B1 * | 4/2002 | Kohno | 439/352 |
| 6,663,411 | B2 * | 12/2003 | Little | 439/352 |
| 6,699,059 | B2 * | 3/2004 | Nagamine et al. | 439/352 |
| 6,815,610 | B2 * | 11/2004 | Kuboshima et al. | 174/360 |
| 7,097,498 | B2 * | 8/2006 | Miyazaki | 439/559 |
| 7,264,518 | B2 * | 9/2007 | Ellis | 439/852 |
| 7,481,685 | B2 * | 1/2009 | Fukaya et al. | 439/852 |
| 7,530,848 | B2 * | 5/2009 | Nagashima et al. | 439/607.41 |

(Continued)

FOREIGN PATENT DOCUMENTS

| | | |
|---|---|---|
| JP | 10-321281 | 4/1998 |
| JP | 2006-147353 A | 6/2006 |
| JP | 2010-267523 | 11/2010 |

OTHER PUBLICATIONS

JP Office Action dated Feb. 3, 2015 and English translation of Notice of Reasons for rejection.

*Primary Examiner* — Thanh Tam Le
(74) *Attorney, Agent, or Firm* — Roberts Mlotkowski Safran & Cole P.C.

(57) ABSTRACT

A connector includes one contact terminal including a contact portion to be in contact with an other contact terminal and a connecting portion to be connected to an electric wire, and a housing including a housing hole formed therein to house the contact portion of the one contact terminal. The one contact terminal contacts with the other contact terminal by inserting the other contact terminal into the housing hole, and the contact portion of the one contact terminal is housed in the housing hole so as to be movable in a direction of intersecting with the insertion direction of the other contact terminal into the housing hole.

11 Claims, 9 Drawing Sheets

(56) References Cited

U.S. PATENT DOCUMENTS

| | | | | |
|---|---|---|---|---|
| 7,578,694 | B2 * | 8/2009 | Takahashi et al. | 439/352 |
| 7,591,694 | B2 * | 9/2009 | Osada | 439/852 |
| 7,597,580 | B1 * | 10/2009 | Advey et al. | 439/383 |
| 7,762,856 | B2 * | 7/2010 | Friesen et al. | 439/843 |
| 7,837,521 | B2 * | 11/2010 | Kato et al. | 439/843 |
| 8,021,199 | B2 * | 9/2011 | Ambo et al. | 439/752 |
| 8,303,355 | B2 * | 11/2012 | Ono et al. | 439/877 |
| 8,333,622 | B2 * | 12/2012 | Blasko et al. | 439/852 |
| 8,425,256 | B2 * | 4/2013 | Aoki et al. | 439/620.26 |
| 8,485,844 | B2 * | 7/2013 | Omae et al. | 439/559 |
| 2009/0137153 | A1 * | 5/2009 | Yoshioka et al. | 439/607.24 |
| 2012/0252272 | A1 * | 10/2012 | Omae et al. | 439/607.01 |

* cited by examiner

1 CONNECTOR

10 WIRE HARNESS

CONNECTOR AND WIRE HARNESS

The present application is based on Japanese patent application Nos. 2011-195842 and 2012-048666 filed on Sep. 8, 2011 and Mar. 6, 2012, respectively, the entire contents of which are incorporated herein by reference.

BACKGROUND OF THE INVENTION

1. Field of the Invention

The invention relates to a connector with a female terminal enclosed in a housing, and a wire harness provided with the connector.

2. Description of the Related Art

JP-A-2006-147353 discloses a connector with a housing to which a female terminal to be connected to a male terminal is attached.

The connector of JP-A-2006-147353 has an L-shaped female terminal which is housed in a synthetic resin housing. The housing and the female terminal are housed in a metal shell the inside of which is kept shielded.

SUMMARY OF THE INVENTION

This type of connector may be connected to a male connector with a male terminal equipped at the side of a device such as an inverter or a motor. When the male terminal is fitted to the female terminal, due to an error in attached position of the male terminal, the contact pressure at the contact point between the two terminals may lower so as to lose the good contact between the terminals. In addition, when the connector is connected to a vibration generating device such as a motor or a peripheral thereof, a small sliding motion caused by the vibration may occur between the male and female terminals due to the decrease in the contact pressure, so that the contact point between the two terminals can be worn away.

Accordingly, it is an object of the invention to provide a connector and a wire harness that allows an error in attached position of the male terminal and keeps the good contact with the female terminal even when there is an error in the attached position of the male terminal.

(1) According to one embodiment of the invention, a connector comprises:

one contact terminal comprising a contact portion to be in contact with an other contact terminal and a connecting portion to be connected to an electric wire; and a housing comprising a housing hole formed therein to house the contact portion of the one contact terminal, wherein the one contact terminal contacts with the other contact terminal by inserting the other contact terminal into the housing hole, and wherein the contact portion of the one contact terminal is housed in the housing hole so as to be movable in a direction of intersecting with the insertion direction of the other contact terminal into the housing hole.

In the above embodiment (1) of the invention, the following modifications and changes can be made.

(i) The one contact terminal is a female terminal having a fit portion as the contact portion for fitting the other contact terminal thereinto, and the other contact terminal is a male terminal being at least partially housed in the fit portion.

(ii) The fit portion of the one contact terminal is movable inside the housing hole in a direction orthogonal to a contact surface of the other contact terminal formed in a plate shape.

(iii) The fit portion of the one contact terminal is movable inside the housing hole in a first direction orthogonal to the contact surface of the other contact terminal formed in a plate shape and in a second direction orthogonal to the first direction and to the insertion direction of the other contact terminal.

(iv) The one contact terminal further comprises a spring member for pressing the other contact terminal against a contact point thereof in the fit portion.

(v) The one contact terminal is formed such that the fit portion is formed along the insertion direction of the other contact terminal and is bent to form the connecting portion that extends in a direction of intersecting with the insertion direction, and an abutting portion is formed on the housing to restrict movement of the female terminal in the insertion direction by abutting against the fit portion.

(vi) The one contact terminal is a male terminal and the other contact terminal is a female terminal.

(2) According to another embodiment of the invention, a wire harness comprises:

the connector according to the embodiment (1); and an electric wire comprising a core wire comprising a stranded wire connected to the connecting portion of the one contact terminal and a covering member for covering the core wire, wherein the electric wire comprises a flexible portion with a flexibility increased by untwisting the core wire formed between a front end portion connected to the connecting portion and a supported portion supported by the housing.

In the above embodiment (2) of the invention, the following modifications and changes can be made.

(vii) The housing further comprises a wire holding portion comprising a wire housing recess for holding the electric wires and housing the electric wires, wherein a central axis of the housing hole in a width direction thereof coincides with a central axis of the wire housing recess in a width direction thereof.

Points of the Invention

According to one embodiment of the invention, a connector is constructed such that a fit portion of a female terminal for receiving a mating male terminal thereinto is loose-fitted into a housing hole of a housing of the female terminal. This allows the fit portion of the female terminal to move in the first direction (i.e., height direction) and the second direction (i.e., width direction) inside the housing hole. Thus, since the fit portion of the female terminal is movable in the housing hole, the fit portion moves inside the housing hole according to the male terminal even when there is an error in the attached position of the male terminal at the side of the device. Therefore, it is possible to obtain the good contact between the female terminal and the male terminal.

BRIEF DESCRIPTION OF THE DRAWINGS

Next, the present invention will be explained in more detail in conjunction with appended drawings, wherein:

FIGS. 1A to 1E are diagrams illustrating a connector in an embodiment of the present invention, wherein FIG. 1A is a top view, FIG. 1B is a front view, FIG. 1C is a cross sectional view taken on line A-A in FIG. 1A, FIG. 1D is a right side view and FIG. 1E is a rear view;

FIGS. 2A and 2B are diagrams illustrating an internal structure of the connector, wherein FIG. 2A is a rear view and FIG. 2B is a perspective view;

FIGS. 3A to 3E are diagrams illustrating a second housing member, wherein FIG. 3A is a top view, FIG. 3B is a front view, FIG. 3C is a cross sectional view taken on line C-C in FIG. 3B, FIG. 3D is a rear view and FIG. 3E is a perspective view;

FIGS. 7A and 7B are diagrams illustrating a fitted state of the male and female terminals, wherein FIG. 7A is a cross sectional view taken along a center axis $C_1$ of the fit portion of the female terminal and FIG. 7B is a cross sectional view orthogonal to the center axis $C_1$;

DETAILED DESCRIPTION OF THE PREFERRED EMBODIMENTS

Embodiments

A connector and a wire harness in an embodiment of the invention will be described below in reference to FIGS. 1A to 9C. The connector and the wire harness are mounted on, e.g., a vehicle having an electric motor as a driving source, and is used for connection between the electric motor and an inverter supplying three-phase AC to the electric motor. In other words, the connector is connected to a connector preliminarily fixed to the electric motor or the inverter.

Figures 1A, 1B, 1C, 1D, 1E:
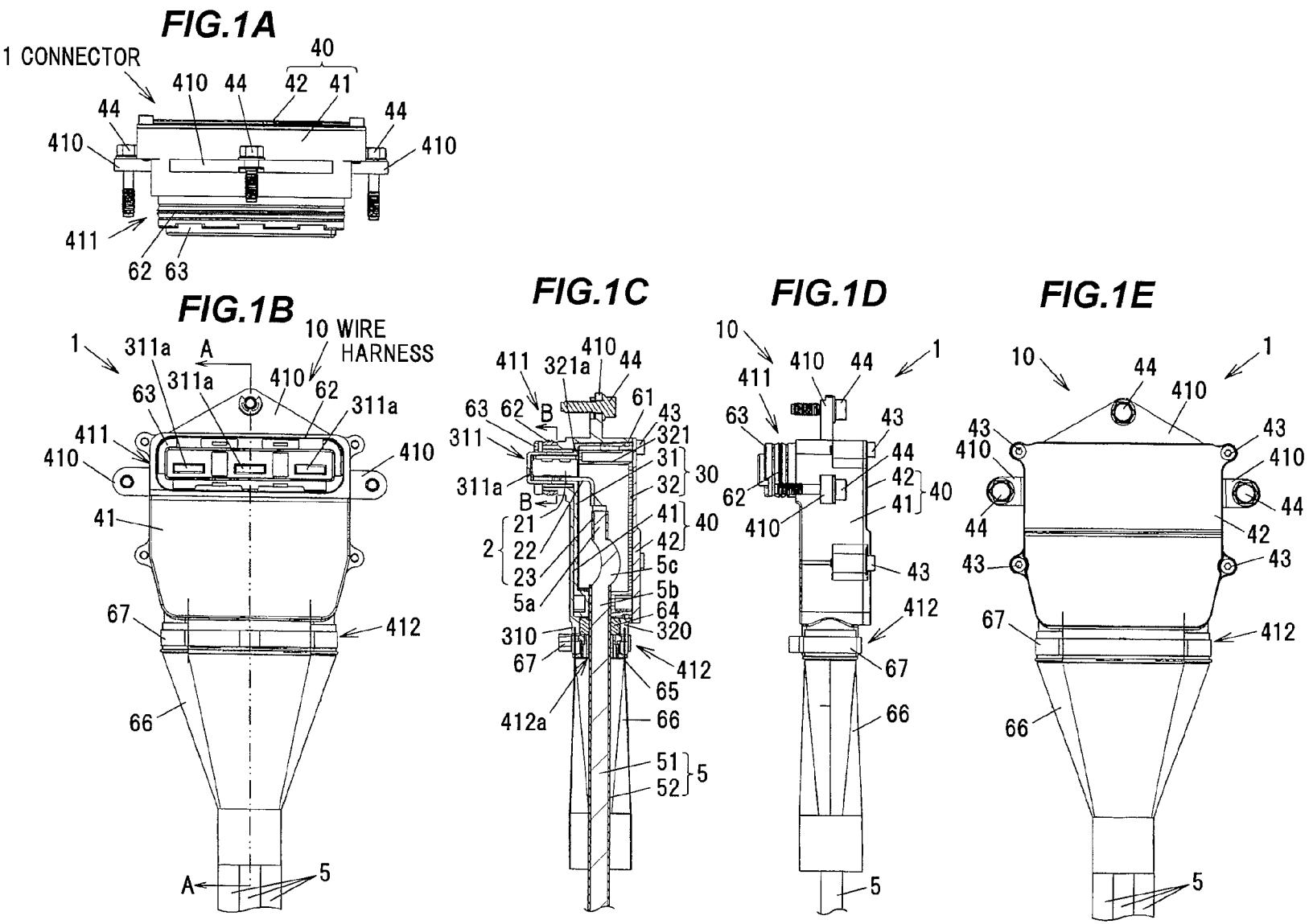
Figure 2A:
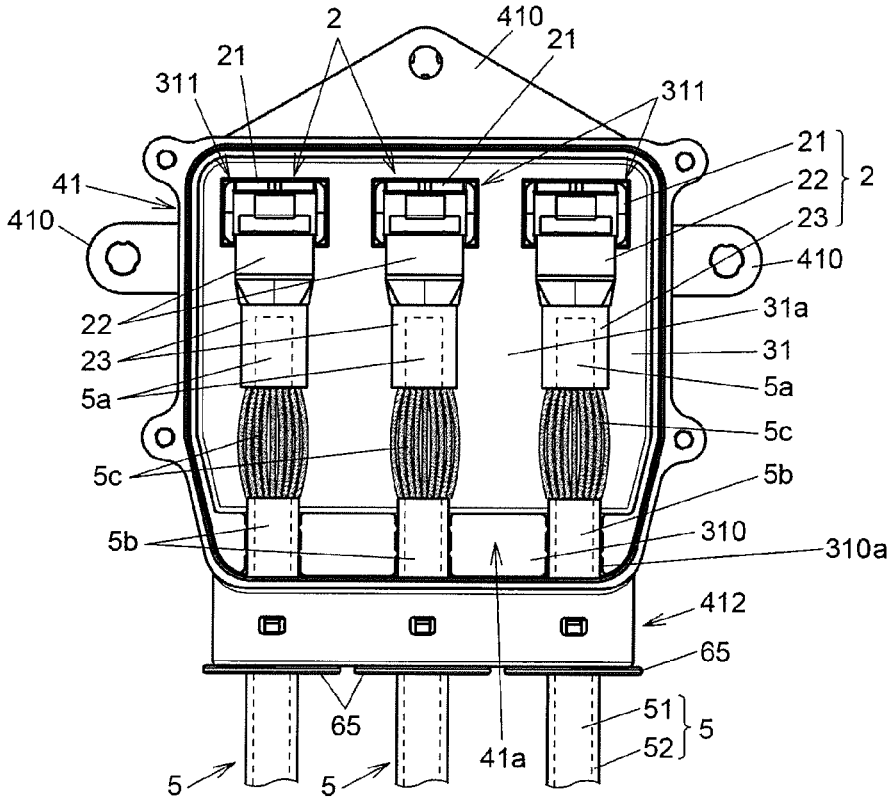
Figure 2B:
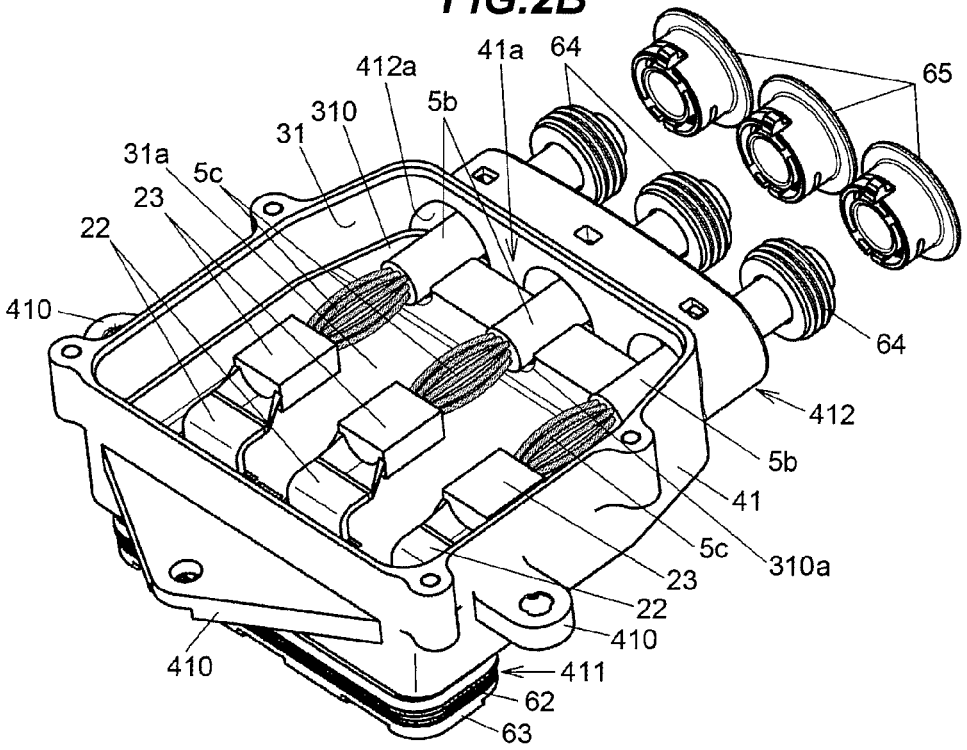

FIGS. 1A to 1E are diagrams illustrating a connector in an embodiment of the present invention, wherein FIG. 1A is a top view, FIG. 1B is a front view, FIG. 1C is a cross sectional view taken on line A-A in FIG. 1A, FIG. 1D is a right side view and FIG. 1E is a rear view. FIGS. 2A and 2B are diagrams illustrating an internal structure of the connector, wherein FIG. 2A is a rear view and FIG. 2B is a perspective view.

A connector 1 is provided with a female terminal 2 as an example of a contact terminal, a housing 30 for housing the female terminal 2 and a metal shell 40 for housing the female terminal 2 and the housing 30. In the present embodiment, three female terminals 2 are housed in the housing 30. Three electric wires 5 are respectively connected to the three female terminals 2. The three electric wires 5 are each arranged linearly in the housing 30. A wire harness 10 is composed of the connector 1 and the three electric wires 5.

The housing 30 is composed of a first housing member 31 and a second housing member 32 which face each other with the three electric wires 5 interposed therebetween. The first housing member 31 and the second housing member 32 are formed of, e.g., an insulating resin such as PBT (polybutylene terephthalate), etc. Wire holding portions 310 and 320 for holding the electric wires 5 are formed in the housing 30. The electric wire 5 is sandwiched and held between the wire holding portion 310 of the first housing member 31 and the wire holding portion 320 of the second housing member 32. The wire holding portions 310 and 320 have three wire housing recesses 310*a* and 320*a*, respectively, housing a portion of the electric wire 5.

The shell 40 is composed of a first shell member 41 located on the first housing member 31 side and a second shell member 42 located on the second housing member 32 side. The first shell member 41 and the second shell member 42 are formed of, e.g., conductive metal such as aluminum. An O-ring 61 is arranged between the second shell member 42 and the second housing member 32.

In addition, the metal shell 40 is configured to house the three female terminals 2 and the housing 30 in the first shell member 41 and then to cover an opening of the first shell member 41 by the plate-shaped second shell member 42. FIGS. 2A and 2B show the state that the second shell member 42 and the second housing member 32 are detached from the connector 1.

The first shell member 41 is fixed to the second shell member 42 by plural (four in the present embodiment) bolts 43. Three bolt holding portions 410 which protrude outward are formed on the first shell member 41 and each bolt holding portion 410 rotatably holds a bolt 44 used for fixing the connector 1 to a device such as an inverter.

The female terminal 2 integrally includes a fit portion 21 for fitting a male terminal 7 (described later) which is an example of a other contact terminal, a wire connecting portion 23 each connected to an end of a core wire 51 of the electric wire 5 and a coupling portion 22 for coupling the fit portion 21 to the wire connecting portion 23.

The fit portion 21 is an example of a contact portion which comes into contact with the male terminal 7.

Three housing holes 311 for housing respective fit portions 21 of the three female terminals 2 are formed on the first housing member 31. The three housing holes 311 are lined in a row. In addition, each housing hole 311 is formed in a bottomed cylindrical shape having a cylindrical portion which extends along a direction orthogonal to a planar bottom surface 31*a* facing the second housing member 32, and a slit-like opening 311*a* for inserting a contact portion 71 of the below-described male terminal 7 is each formed on the bottom of the housing hole 311. A central axis of the housing hole 311 of the first housing member 31 in a width direction thereof (i.e., a horizontal direction in FIG. 2A) substantially coincides with a central axis of the wire housing recess 310*a* in a width direction thereof (i.e., the horizontal direction in FIG. 2A), and furthermore, the central axes coincide with an axis of the electric wire 5. Herein, "coincide" means not only having a complete coincidence but also having a little misalignment (e.g., about 5 mm) from the complete coincidence.

A first cylindrical portion 411 is formed on the first shell member 41, and the fit portion 21 of the female terminal 2 housed in the each housing hole 311 of the first housing member 31 is inserted thereinto. An annular sealing member 62 is held on an outer peripheral surface of the first cylindrical portion 411. In addition, a resin cover member 63 is locked to a front end face of the first cylindrical portion 411.

In addition, a second cylindrical portion 412 for inserting the three electric wires 5 is formed on the first shell member 41. Three insertion holes 412*a* for respectively inserting the three electric wires 5 are formed on the second cylindrical portion 412. The insertion hole 412*a* is formed such that the axial direction thereof is parallel to the second shell member 42. The axial direction of the insertion hole 412*a* is orthogonal to the protruding direction of the first cylindrical portion 411. In other words, of the six surfaces of the rectangular parallelepiped-shaped shell 40, the surface having the insertion hole 412*a* formed thereon is orthogonal to the second shell member 42. Further, the surface having the first cylindrical portion 411 formed thereon is orthogonal to the surface having the insertion hole 412*a* formed thereon and is opposite to the second shell member 42.

A sealing member 64 for sealing a gap between an outer peripheral surface of the electric wire 5 and an inner peripheral surface of the insertion hole 412*a* is housed in each insertion holes 412*a*. Slipping off of each sealing member 64 is prevented by a cover member 65 which is locked to the second cylindrical portion 412. Note that, FIG. 2B shows a state before attaching the sealing member 64 and the cover member 65 to the second cylindrical portion 412.

The electric wire 5 has a core wire 51 and a coating member 52 for coating the core wire 51. The core wire 51 is a stranded wire (parent strand) formed by twisting plural conductor strands together to form a child strand and further twisting plural child strands together.

The wire holding portion 310 of the first housing member 31 and the wire holding portion 320 of the second housing member 32 hold an outer periphery of the coating member 52 of the electric wire 5. In addition, the coating member 52 is removed on a tip side beyond the portion held by the wire holding portions 310 and 320 to expose the core wire 51.

A flexible portion 5*c* having flexibility improved by unraveling the twist of the core wire 51 is formed between a front end portion 5*a* of the electric wire 5 connected to the wire connecting portion 23 of the female terminal 2 and a supported portion 5*b* supported by the wire holding portions 310 and 320. The outer diameter of the flexible portion 5*c* is expanded compared to the front end portion 5*a* and the supported portion 5*b* since the twist thereof (at least a portion of the parent strand of the parent and child strands) is unraveled. Owing to the flexible portion 5*c* formed therebetween, the front end portion 5*a* and supported portion 5*b* of the electric wire 5 are relatively movable in the axial (or longitudinal) direction of the electric wire 5. In other words, the fit portion 21 of the terminal 2 is relatively movable with respect to the supported portion 5*b* in the axial (or longitudinal) direction of the electric wire 5. This allows the fit portion 21 to easily move along the male terminal 7. In addition, owing to the flexible portion 5*c* formed therebetween, the fit portion 21 is relatively movable with respect to the supported portion 5*b* also in a direction crossing the axial (or longitudinal) direction of the electric wire 5. Thus, since the fit portion 21 is relatively movable with respect to the supported portion 5*b* in the axial (or longitudinal) direction of the electric wire 5 and in the direction crossing the axial (or longitudinal) direction, the fit portion 21 can rotate about an axis defined in the direction crossing (or orthogonal to) the axial (or longitudinal) direction of the electric wire 5.

The middle portion of the flexible portion 5*c* is curved so as to separate from the bottom surface 31*a* of the first housing member 31. This allows the fit portion 21 to easily move relatively with respect to the supported portion 5*b* in the axial (or longitudinal) direction of the electric wire 5.

Meanwhile, as shown in FIGS. 1B to 1E, a shield wire 66 for blocking electromagnetic wave radiated from the electric wire 5 is fixed to the second cylindrical portion 412 by a band-like clamping member 67.

Figure 3A:
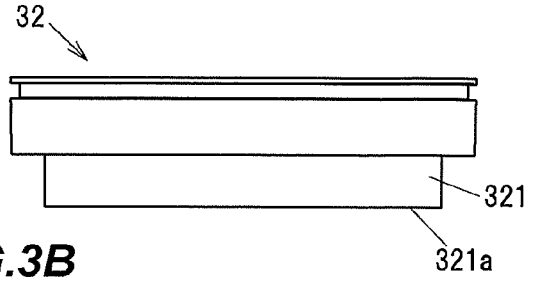
Figure 3B:
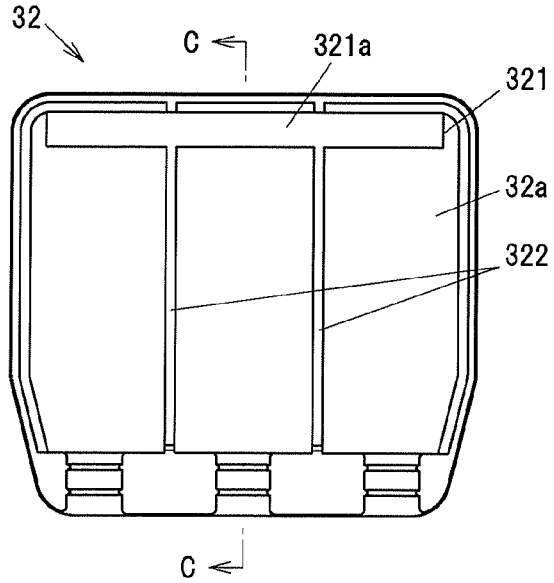
Figure 3C:
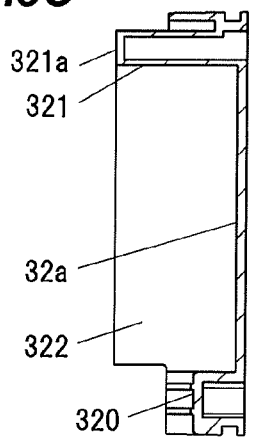
Figure 3D:
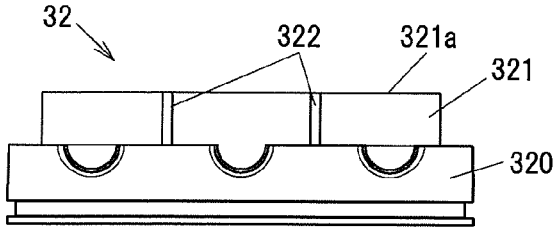
Figure 3E:
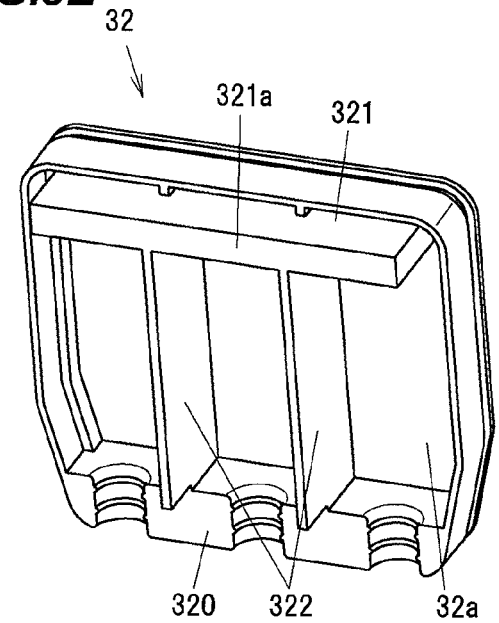

FIGS. 3A to 3E are diagrams illustrating the second housing member 32, wherein FIG. 3A is a top view, FIG. 3B is a front view, FIG. 3C is a cross sectional view taken on line C-C in FIG. 3B, FIG. 3D is a rear view and FIG. 3E is a perspective view.

An abutting portion 321 is formed on the second housing member 32 so as to be orthogonal to a bottom surface 32*a* which faces the bottom surface 31*a* of the first housing member 31. The abutting portion 321 is formed so as to vertically extend from the bottom surface 32*a* toward the first housing member 31. A front end face 321*a* of the abutting portion 321 faces one end face of the fit portion 21 of the female terminal 2 (an end face opposite to the opening 311*a*) as shown in FIG. 1C. Then, the abutting portion 321 restricts movement of the female terminal 2 in one direction (a fitting direction of the below-described male terminal 7) by abutment of the front end face 321*a* against the fit portion 21.

In addition, two wall portions 322 partitioning a space for housing the three female terminals 2 are formed on the second housing member 32 so as to be continuous with the abutting portion 321. The wall portion 322 is formed to extend in a direction orthogonal to a longitudinal direction of the abutting portion 321.

Structure of Female Terminal and Male Terminal

Figure 4:
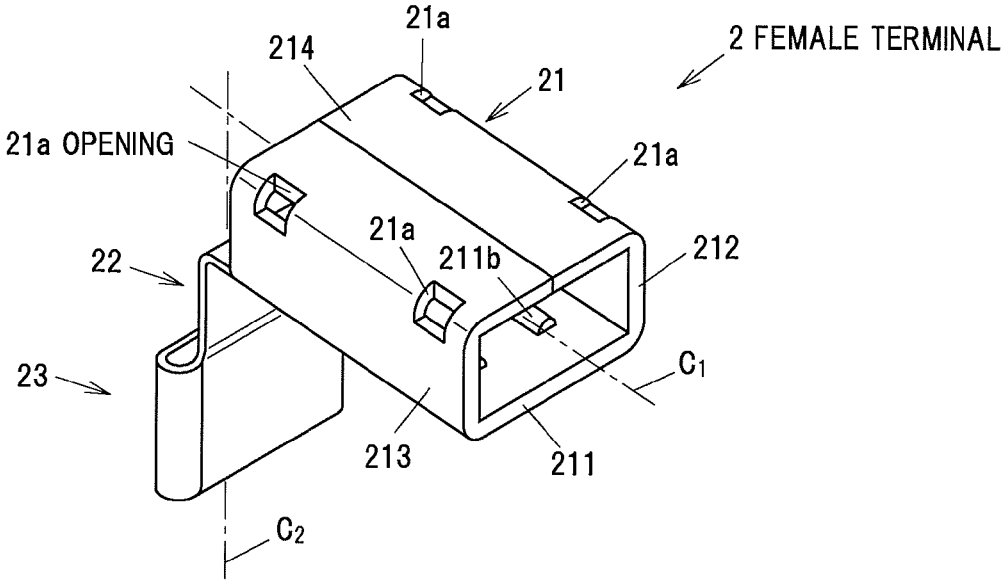
FIG. 4 is a perspective view showing a female terminal.
Figure 5:
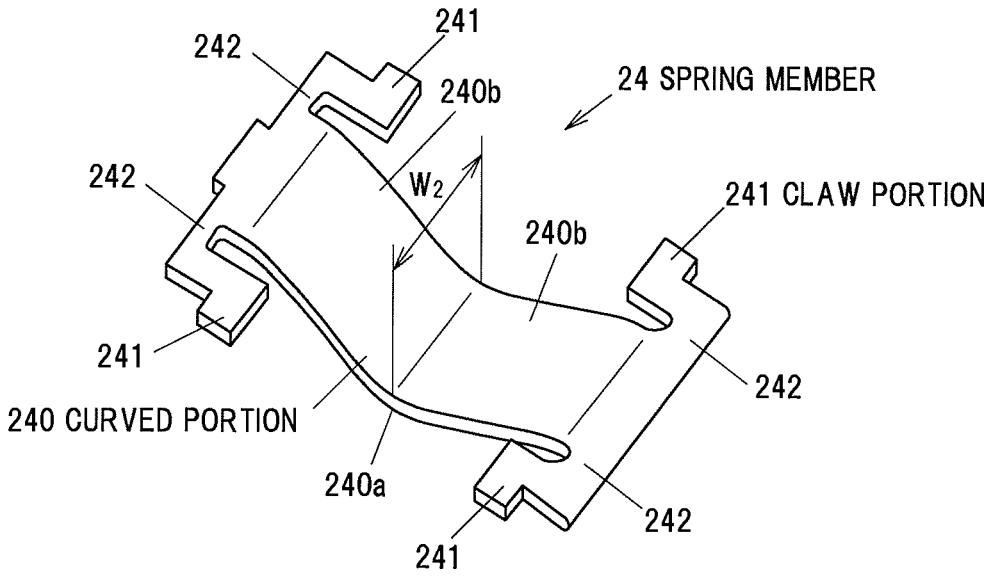
FIG. 5 is a perspective view showing a spring member which is housed in a fit portion of the female terminal.
Figure 6:
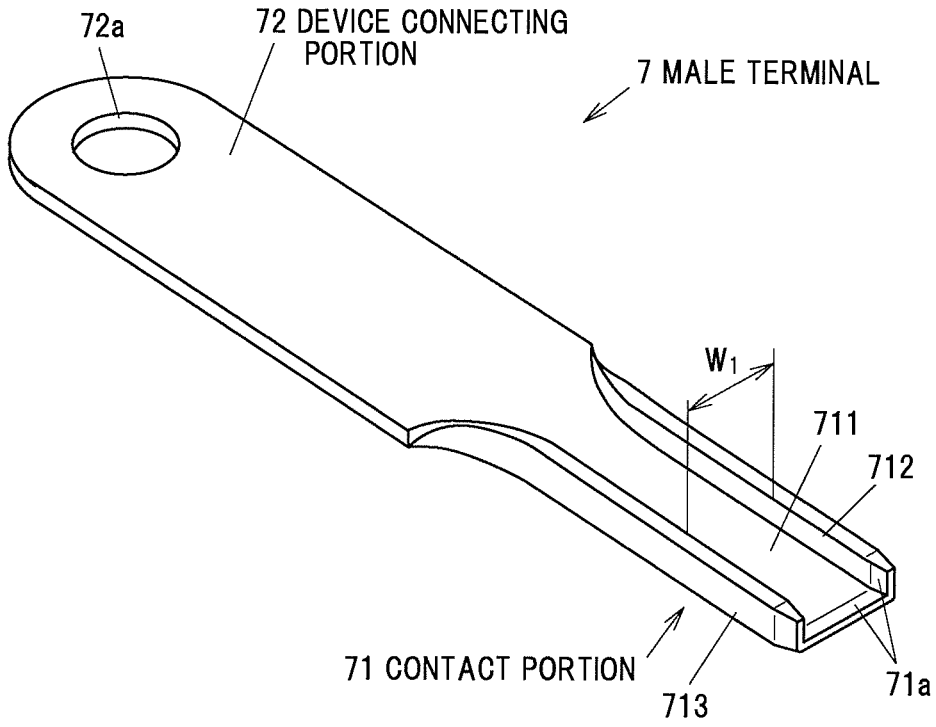
FIG. 6 is a perspective view showing a male terminal to be fitted into the female terminal.

FIG. 4 is a perspective view showing the female terminal 2. FIG. 5 is a perspective view showing a spring member 24 which is housed in the fit portion 21 of the female terminal 2. FIG. 6 is a perspective view showing the male terminal 7 to be fitted into the female terminal 2.

As shown in FIG. 4, the female terminal 2 has the fit portion 21 for fitting the male terminal 7 therein at one end and the wire connecting portion 23 to be connected to the front end portion 5*a* of the electric wire 5 at another end, and the fit portion 21 is coupled to the wire connecting portion 23 by the coupling portion 22. As a material of the female terminal 2, it is possible to use, e.g., conductive material such as carbon steel, stainless steel, copper and copper alloy. Alternatively, the surface of the female terminal 2 may be plated with tin, etc.

The fit portion 21 is in a cylinder shape into which the male terminal 7 is inserted, and is formed along the fitting direction of the male terminal 7. The fit portion 21 has a rectangular cross sectional shape of which four sides are a bottom portion 211, a pair of side portions 212, 213 and a ceiling portion 214. In more detail, the bottom portion 211, the pair of side portions 212, 213 and the ceiling portion 214 are each formed in a plate-shaped shape, the bottom portion 211 faces the ceiling portion 214 and is coupled to the pair of side portions 212, 213 to which the ceiling portion 214 is also coupled.

In addition, four openings 21*a* for respectively locking four claw portions 241 of a spring member 24 are formed on the fit portion 21 at corners formed between the ceiling portion 214 and the pair of side portions 212, 213. In addition, a pair of protruding strips 211*b* extending along a longitudinal direction inside the fit portion 21 is formed on the bottom portion 211.

The wire connecting portion 23 has a flat-oval tubular shape and the front end portion 5*a* of the electric wire 5 is crimped thereto by, e.g., caulking. The female terminal 2 is formed so that a center axis $C_1$ of the fit portion 21 and a center axis $C_2$ of the wire connecting portion 23 are orthogonal to each other. That is, the female terminal 2 is formed so that the fit portion 21 is formed along the fitting direction of the male terminal 7 and the wire connecting portion 23 is formed to extend in a direction crossing the fitting direction of the male terminal 7.

As shown in FIG. 5, the spring member 24 integrally includes a curved portion 240 formed to be moderately curved, four L-shaped claw portions 241 to be locked into the openings 21*a* of the female terminal 2 and coupling portions 242 for coupling the curved portion 240 to the claw portions 241. The curved portion 240 further includes a top portion 240*a* at the middle in a curving direction and a pair of slopes 240*b* inclined in directions opposite to each other with the top portion 240*a* interposed therebetween. As a material of the spring member 24, it is possible to use, e.g., metal material such as stainless steel, phosphor bronze and beryllium copper, etc., or non-metal material such as rubber, etc.

As shown in FIG. 6, on the male terminal 7, a contact portion 71 to be inserted into the fit portion 21 of the female terminal 2 is provided at one end and a device connecting portion 72 to be electrically connected to an internal wiring of a device such as an inverter is provided at an another end. The contact portion 71 and the device connecting portion 72 are formed from a single plate. The contact portion 71 as a portion of the male terminal 7 is received in the fit portion 21, and the male terminal 7 thereby comes into contact with the female terminal 2. In other words, insertion of the male terminal 7 into the housing hole 311 of the first housing member 31 brings the contact portion 71 into contact with the female terminal 2. The insertion direction of the male terminal 7 (the contact portion 71) into the housing hole 311 is used synonymously with the direction of fitting the contact portion 71 into the fit portion 21.

The contact portion 71 has a substantially squared-U cross sectional shape composed of a plate-shaped bottom portion 711 and a pair of plate-shaped upright portions 712, 713 which are formed by bending the bottom portion 711 so as to be orthogonal thereto and so as to face each other. In addition, a front end portion 71*a* of the contact portion 71 is formed in a tapered shape tapering in a thickness direction. A width $W_1$ between inner surfaces of the upright portions 712, 713 is set to larger than a width $W_2$ of the curved portion 240 of the spring member 24 (see FIG. 5).

The plate-shaped device connecting portion 72 is electrically connected to an internal wiring of a device and has a device connecting hole 72*a* formed for fixation to the device using a bolt.

Figure 7A:
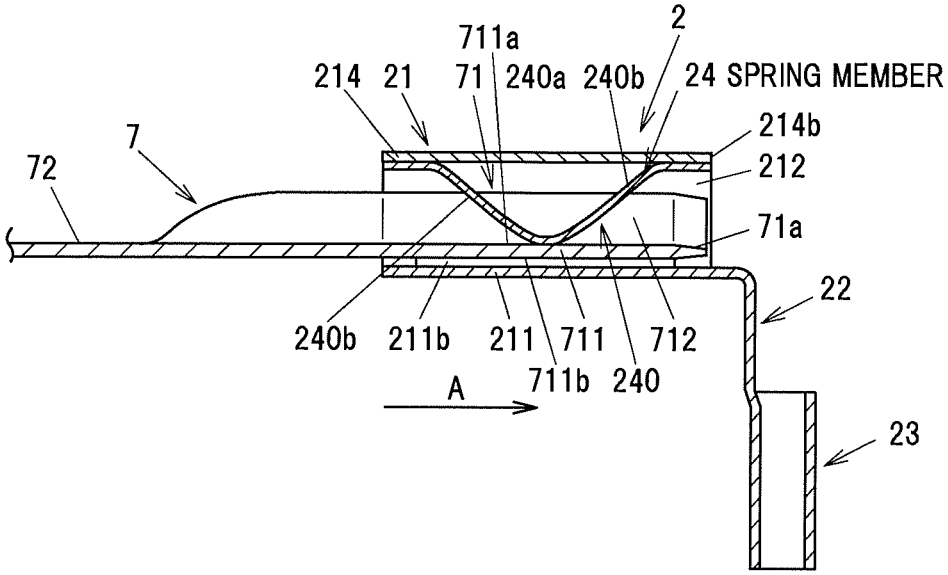
Figure 7B:
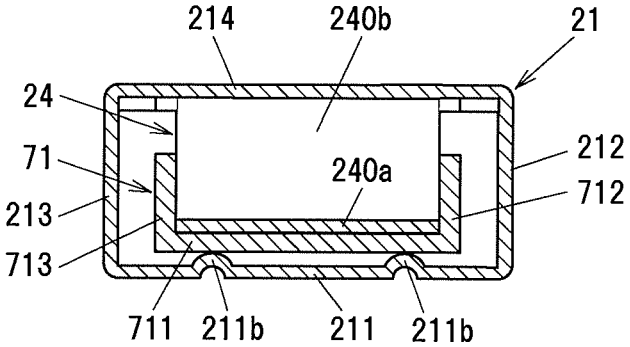

FIGS. 7A and 7B are diagrams illustrating a fitted state of the male terminal 7 and the female terminal 2, wherein FIG. 7A is a cross sectional view taken along the center axis $C_1$ of the fit portion 21 of the female terminal 2 and FIG. 7B is a cross sectional view orthogonal to the center axis $C_1$.

The contact portion 71 of the male terminal 7 is inserted into the fit portion 21 of the female terminal 2, thereby fitting the male terminal 7 into the female terminal 2.

When inserting the contact portion 71 of the male terminal 7, the top portion 240*a* of the curved portion 240 of the spring member 24 comes into contact with one flat surface 711*a* of the bottom portion 711, and another flat surface 711*b* of the bottom portion 711 is pressed by an elastic force of the spring member 24 against the pair of protruding strips 211*b* formed on the bottom portion 211 of the fit portion 21. That is, the other flat surface 711*b* of the bottom portion 711 is a contact surface with the fit portion 21 (the bottom portion 211) of the female terminal 2, and a contact portion between the flat surface 711*b* and the protruding strip 211*b* is a contact point between the female terminal 2 and the male terminal 7.

Meanwhile, the female terminal 2 is formed in an L-shape so that an extending direction of the fit portion 21 along the fitting direction of the male terminal 7 (a direction of arrow A) is orthogonal to an extending direction of the wire connecting portion 23. One end face 214*b* (an end face opposite to an insertion side of the male terminal 7) of the ceiling portion 214 in the extending direction of the fit portion 21 is in contact with the front end face 321*a* of the abutting portion 321 of the second housing member 32 (see FIG. 1C) in the connector 1. The front end face 321*a* of the abutting portion 321 is formed so as to be orthogonal to the fitting direction of the male terminal 7.

Figure 8:
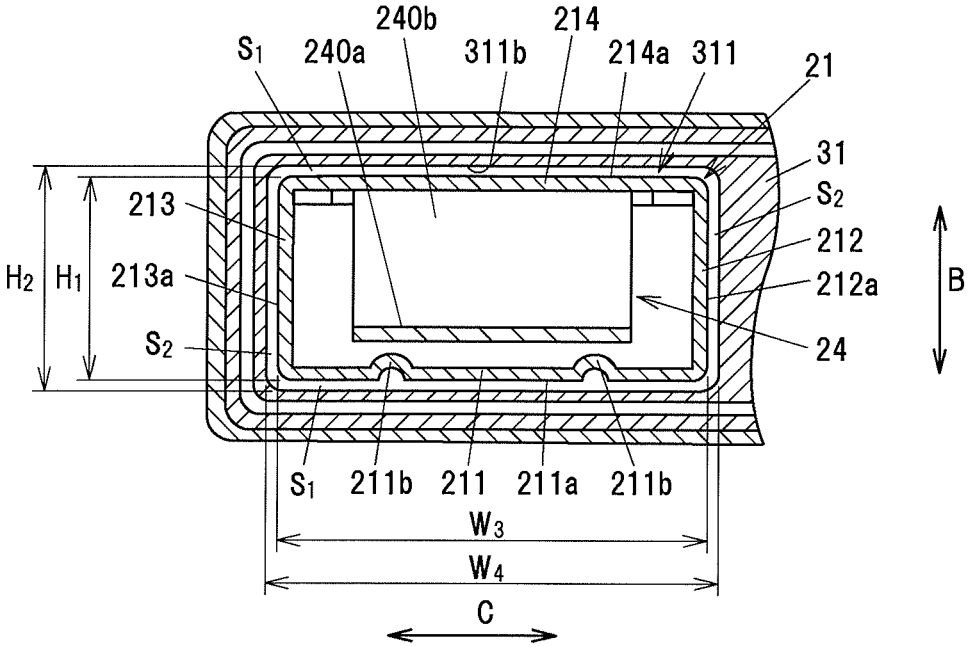
FIG. 8 is a cross sectional view showing the female terminal and the periphery thereof taken on line B-B in FIG. 1C.

FIG. 8 is a cross sectional view showing the female terminal 2 and the periphery thereof taken on line B-B in FIG. 1C.

As shown in FIG. 8, a dimension $H_1$ of the fit portion 21 in a height direction which is orthogonal to an outer surface 211*a* of the bottom portion 211 and to an outer surface 214*a* of the ceiling portion 214 of the female terminal 2 is designed to be smaller than a dimension $H_2$ of an inner surface 311*b* of the housing hole 311 of the first housing member 31 in a height direction. In addition, a dimension $W_3$ of the fit portion 21 in a width direction which is orthogonal to outer surfaces 212*a*, 213*a* of the pair of side portions 212, 213 of the female terminal 2 is designed to be smaller than a dimension $W_4$ of an inner surface 311*b* of the housing hole 311 of the first housing member 31 in a width direction. Here, the height direction is a first direction (a direction of arrow B) which is orthogonal to the flat surface 711*b* of the bottom portion 711 of the male terminal 7, and the width direction is a second direction (a direction of arrow C) which is orthogonal to the first direction and to the fitting direction of the male terminal 7 into the female terminal 2.

Between the outer surfaces 211*a*, 212*a*, 213*a* and 214*a* of the fit portion 21 of the female terminal 2 and the inner surface 311*b* of the housing hole 311, a space $S_1$ in the first direction is formed by a difference between the dimension $H_1$ and the dimension $H_2$, and a space $S_2$ in a second direction is formed by a difference between the dimension $W_3$ and the dimension $W_4$. In other words, the fit portion 21 of the female terminal 2 is loose-fitted into the housing hole 311. This allows the fit portion 21 of the female terminal 2 to move in the first and second directions inside the housing hole 311.

In addition, the difference between the dimension $H_1$ and the dimension $H_2$ and that between the dimension $W_3$ and the dimension $W_4$ should be 0.2 to 0.6 mm. In this case, when the fit portion 21 of the female terminal 2 is located in the middle portion of the housing hole 311, the dimension of the space $S_1$ in the first direction and the dimension of the space $S_2$ in the second direction are 0.1 to 0.3 mm. In the present embodiment, the difference between the dimension $H_1$ and the dimension $H_2$ and that between the dimension $W_3$ and the dimension $W_4$ are determined to be 0.4 mm (the dimensions of the space $S_1$ and the space $S_2$ are 0.2 mm).

The contact portion 71 of the male terminal 7 is inserted into the fit portion 21 of the female terminal 2 through the opening 311*a* (see FIGS. 1B and 1C) formed on the bottom of the housing hole 311. The opening 311*a* is formed at a position opposite to the slope 240*b* of the curved portion 240 of the spring member 24 in a fitting direction or at a position opposite to the position between the top portion 240*a* of the curved portion 240 and the protruding strip 211*b* of the fit portion 21.

As a result, when the contact portion 71 of the male terminal 7 enters between the top portion 240*a* of the curved portion 240 and the protruding strip 211*b* of the fit portion 21, fitting of the male terminal 7 into the female terminal 2 is completed without large movement of the fit portion 21 of the female terminal 2 in the first direction. Meanwhile, when the contact portion 71 abuts against the slope 240*b* of the curved portion 240, the female terminal 2 relatively moves with respect to the male terminal 7 in the first direction and the contact portion 71 of the male terminal 7 is guided between the top portion 240*a* of the curved portion 240 and the protruding strip 211*b* of the fit portion 21.

In addition, the fit portion 21 of the female terminal 2 is relatively movable with respect to the male terminal 7 in the second direction so as to be guided between the pair of upright portions 712, 713 of the contact portion 71 of the male terminal 7.

Assembly Procedure of the Connector 1

Figure 9A:
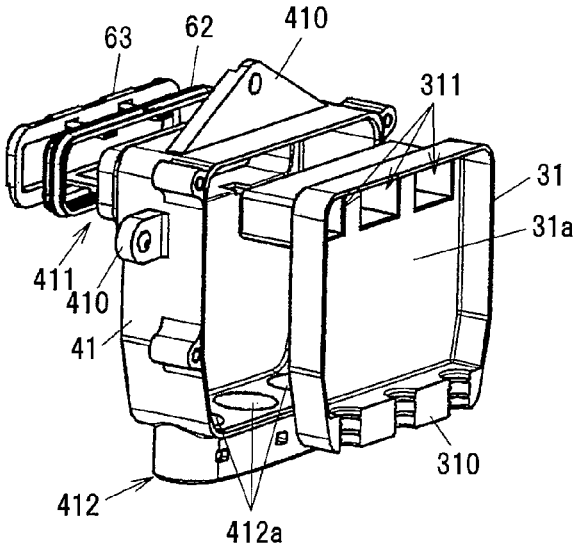
FIGS. 9A to 9C are explanatory diagrams illustrating an example of an assembly procedure of the connector.
Figure 9B:
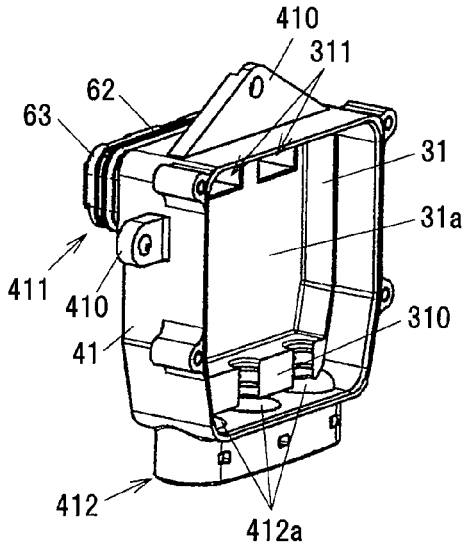
Figure 9C:
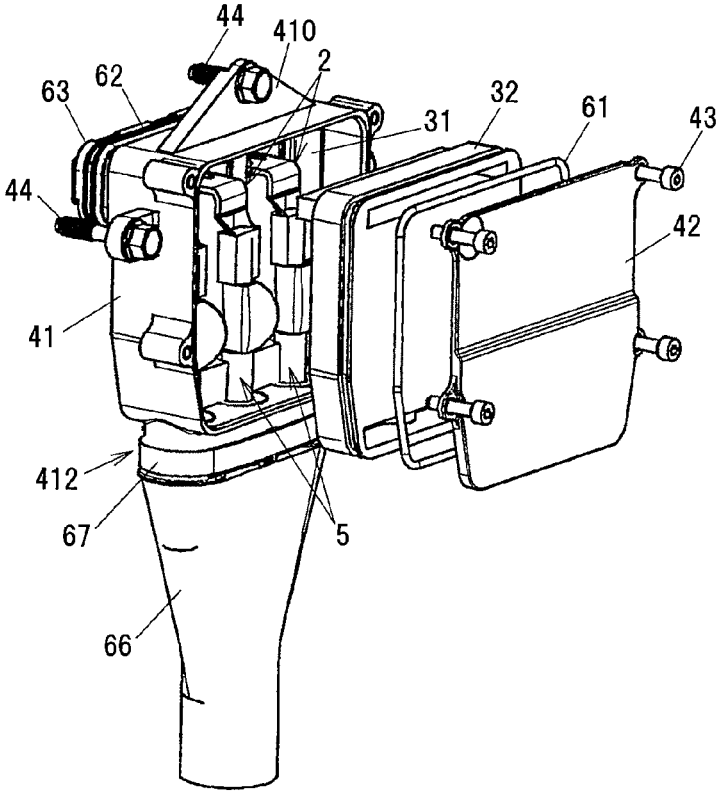

Next, an assembly procedure of the connector 1 will be described in reference to FIGS. 9A to 9C. FIGS. 9A to 9C are explanatory diagrams illustrating an example of an assembly procedure of the connector 1.

For assembling the connector 1, the first housing member 31, the sealing member 62 and the cover member 63 are sequentially assembled to the first shell member 41, as shown in FIG. 9A. FIG. 9B shows an assembly-completed state.

Next, the fit portions 21 of the female terminals 2 in which the electric wires 5 are connected to the wire connecting portions 23 are inserted into the three housing holes 311 of the first housing member 31. Note that, the flexible portion 5*c* is preliminarily formed by unraveling the core wire 51 before inserting the fit portions 21 into the housing hole 311.

Following this, the second housing member 32 and the O-ring 61 are housed in the first shell member 41, and the second shell member 42 is fixed to the first shell member 41 by the bolts 43. Then, the shield wire 66 is fixed to the second cylindrical portion 412 of the first shell member 41 by the clamping member 67, thereby completing the assembly of the connector 1.

Functions and Effects of the Embodiment

The following functions and effects can be obtained by the embodiment.

(1) Since the fit portion 21 of the female terminal 2 is movable in the housing hole 311 of the first housing member 31, the fit portion 21 moves inside the housing hole 311 according to the male terminal 7 even when there is an error in the attached position of the male terminal 7 at the side of the device. Therefore, it is possible to obtain the good contact between the female terminal 2 and the male terminal 7.

(2) Since the fit portion 21 of the female terminal 2 is movable inside the housing hole 311 especially in the first direction (a direction of arrow B in FIG. 8), the fit portion 21 can move or tilt along the male terminal 7 even if the plate-shaped male terminal 7 is inclined in the thickness direction thereof or is bent, and it is thus possible to obtain the good contact with the male terminal 7.

(3) In addition, the fit portion 21 of the female terminal 2 is also movable inside the housing hole 311 in the second direction (a direction of arrow C in FIG. 8), the fit portion 21 can move or tilt along the male terminal 7 even if the plate-shaped male terminal 7 is inclined in the thickness direction thereof and in a direction orthogonal to the thickness direction or is bent, and it is thus possible to obtain good contact with the male terminal 7.

(4) Since the female terminal 2 has the spring member 24 inside the fit portion 21, the male terminal 7 is pressed against the bottom portion 211 of the fit portion 21 (the protruding strip 211*b*) by elasticity of the spring member 24. In addition, when the contact portion 71 of the male terminal 7 comes into contact with the slope 240*b* of the spring member 24, the male terminal 7 and the fit portion 21 of the female terminal relatively move along the inclination of the slope 240*b* and the contact portion 71 of the male terminal 7 is guided between the top portion 240*a* of the spring member 24 and the protruding strip 211*b* of the bottom portion 211. As a result, it is possible to obtain good contact with the male terminal 7.

(5) The movement of the female terminal 2 in the fitting direction at the time of fitting the male terminal 7 is restricted by abutting against the abutting portion 321 of the second housing member 32. Since the front end face 321*a* of the abutting portion 321 is formed so as to be orthogonal to the direction of fitting the male terminal 7 into the female terminal 2, the movement of the fit portion 21 of the female terminal 2 in a direction orthogonal to the fitting direction is not interrupted by contact with the front end face 321*a*. This allows the fit portion 21 to freely move according to the male terminal 7 and it is thus possible to obtain good contact between the female terminals 2 and the male terminal 7.

(6) The flexible portion 5*c* formed on the electric wire 5 by unraveling the stranded wire allows the fit portion 21 to move more flexibly as compared to the case without unraveling the stranded wire. As a result, it is possible to obtain good contact between the female terminals 2 and the male terminal 7 while reducing strain due to load applied to the attached position of the male terminal 7. In addition, since the flexible portion 5*c* is formed at a portion of the electric wire 5 by unraveling the stranded wire, it is possible to increase flexibility of the flexible portion 5*c* without increasing the component count. Furthermore, it is possible to easily adjust the position of the fit portion 21 relative to the housing hole 311, thereby easily housing the fit portion 21 in the housing hole 311.

Although the embodiment of the invention has been described, the invention according to claims is not to be limited to the above-mentioned embodiment. Further, please note that not all combinations of the features described in the embodiment are not necessary to solve the problem of the invention.

In addition, although the connector 1 having three female terminals 2 has been described in the embodiment, it is not limited thereto, and there may be only one female terminal 2. The invention is especially effective for a connector and a wire harness having plural female terminals 2 since the individual female terminals 2 can freely move inside the housing hole 311.

In addition, although the case where the core wire 51 of the electric wire 5 is formed of a stranded wire has been described in the embodiment, it is not limited thereto, and the core wire 51 may be a solid wire. In this case, the flexible portion 5*c* can be formed by, e.g., curving a core formed of a solid wire in a connector.

Furthermore, although the female terminal 2 as a contact terminal and the male terminal 7 as a mating terminal are used in the embodiment, it is possible to use the male terminal 7 as a contact terminal and the female terminal 2 as a mating terminal In addition, it is possible to use a bus bar of a device as a mating terminal and a plate-shaped terminal tightened to the bus bar by a bolt as a contact terminal.

What is claimed is:

1. A wire harness, comprising:

one contact terminal comprising a contact portion to be in contact with another contact terminal and a connecting portion to be connected to an electric wire; and a housing comprising a housing hole formed therein to house the contact portion of the one contact terminal, wherein the one contact terminal contacts with the other contact terminal by inserting the other contact terminal into the housing hole, wherein the electric wire comprises a core wire including a stranded wire connected to the connecting portion of the one contact terminal and a covering member for covering the core wire, wherein the one contact terminal is a female terminal including a fit portion as the contact portion to at least partially receive and mate with the other contact terminal, while the other contact terminal is a male terminal to be at least partially received in the mating portion, wherein the fit portion is housed in the housing hole so as to be movable in a direction orthogonal to an insertion direction of the other contact terminal into the housing hole, and wherein a portion of the core wire is being exposed from the covering member and the one contact terminal is being connected to an exposed portion of the core wire without the covering member therebetween, wherein the connecting portion is disposed at a distal end of the one contact terminal, and no portion of the connecting portion contacts the covering portion of the electric wire such that the electric wire is relatively movable in the axial direction.

2. The wire harness according to claim 1, wherein the fit portion of the one contact terminal is movable inside the housing hole in a direction orthogonal to a contact surface of the other contact terminal formed in a plate shape.

3. The wire harness according to claim 1, wherein the fit portion of the one contact terminal is movable inside the housing hole in a first direction orthogonal to the contact surface of the other contact terminal formed in a plate shape and in a second direction orthogonal to the first direction and to the insertion direction of the other contact terminal.

4. The wire harness according to claim 1, wherein the one contact terminal further comprises a spring member for pressing the other contact terminal against a contact point thereof in the fit portion.

5. The wire harness according to claim 1, wherein the one contact terminal is formed such that the fit portion is formed along the insertion direction of the other contact terminal and is bent to form the connecting portion that extends in a direction of intersecting with the insertion direction, and an abutting portion is formed on the housing to restrict movement of the female terminal in the insertion direction by abutting against the fit portion.

6. The wire harness according to claim 1, wherein the electric wire includes a more flexible unstranded core wire portion formed between a tip, which is connected to the connecting portion, and a held portion, which is held to the housing, and between the one contact terminal and the covering member.

7. The wire harness according to claim 6, wherein the core wire is a stranded wire formed by stranding together a plurality of strands each including a respective plurality of conductor wires stranded together, and the more flexible unstranded core wire portion is being formed with the plurality of strands being arranged side by side.

8. The wire harness according to claim 1, wherein the housing further comprises a wire holding portion comprising a wire housing recess for holding the electric wires and housing the electric wires, and wherein a central axis of the housing hole in a width direction thereof coincides with a central axis of the wire housing recess in a width direction thereof.

9. The wire harness according to claim 1, wherein the housing hole is defined by a wall that circumscribes the tubular mating portion, and the sides of the tubular mating portion are spaced apart from the wall defining the housing hole at all points to allow the tubular mating portion to be movable in a plane orthogonal to an insertion direction of the other contact terminal when the other contact terminal is inserted into the housing hole.

10. The wire harness according to claim 9, wherein the sides of the tubular mating portion are spaced apart from the wall defining the housing hole between 0.10 and 0.30 mm.

11. The wire harness according to claim 1, wherein the tubular mating portion terminates in a coplanar edge.

* * * * *